US008252170B2

(12) United States Patent
Sharma et al.

(10) Patent No.: US 8,252,170 B2
(45) Date of Patent: Aug. 28, 2012

(54) OPTIMIZING FEED MIXER PERFORMANCE IN A PARAFFINIC FROTH TREATMENT PROCESS

(75) Inventors: Arun K. Sharma, Missouri City, TX (US); Michael F. Raterman, Doylestown, PA (US)

(73) Assignee: ExxonMobil Upstream Research Company, Houston, TX (US)

( * ) Notice: Subject to any disclaimer, the term of this patent is extended or adjusted under 35 U.S.C. 154(b) by 530 days.

(21) Appl. No.: 12/464,715

(22) Filed: May 12, 2009

(65) Prior Publication Data

US 2009/0321322 A1 Dec. 31, 2009

Related U.S. Application Data

(60) Provisional application No. 61/133,309, filed on Jun. 27, 2008.

(51) Int. Cl.
*C10G 1/00* (2006.01)

(52) U.S. Cl. ..... 208/390

(58) Field of Classification Search ..... 208/390
See application file for complete search history.

(56) References Cited

U.S. PATENT DOCUMENTS

| | | | |
|---|---|---|---|
| 3,556,980 | A | 1/1971 | Clark et al. |
| 3,560,371 | A | 2/1971 | Kaminsky |
| 4,392,941 | A | 7/1983 | Roth et al. |
| 4,676,889 | A | 6/1987 | Hsieh et al. |
| 4,702,815 | A | 10/1987 | Prestridge et al. |
| 5,236,577 | A | 8/1993 | Tipman et al. |
| 5,871,634 | A | 2/1999 | Wiehe et al. |
| 5,876,592 | A | 3/1999 | Tipman et al. |
| 5,997,723 | A | 12/1999 | Wiehe et al. |
| 6,210,560 | B1 | 4/2001 | Wiehe et al. |
| 6,214,213 | B1 | 4/2001 | Tipman et al. |
| 6,355,159 | B1 | 3/2002 | Myers et al. |
| 6,860,979 | B2 | 3/2005 | Sams |
| 7,351,320 | B2 | 4/2008 | Sams |
| 2004/0222164 | A1 | 11/2004 | Conaway et al. |

FOREIGN PATENT DOCUMENTS

| | | |
|---|---|---|
| CA | 2149737 | 3/1999 |
| CA | 2 217 300 | 8/2002 |
| CA | 2 587 866 A1 | 6/2006 |

OTHER PUBLICATIONS

Thomason, William H. et al., "Advanced Electrostatic Technologies for Dehydration of Heavy Oils", SPE/PS-CIM/CHOA 97786, 2005 SPE International Thermal Operations and Heavy Oil Symposium, Nov. 1-3, 2005, pp. 1-7, Calgary, AB, Canada.

NATCO Group, "Trigrid and Trigridmax Electrostatic Dehydrators and Desalters, Designed to Treat the World's Range of Oils", Aug. 2002, Issue 1, pp. 1270A1-1270A2, www.natcogroup.com.

Baker Hughes-Baker Petrolite, Excalibur Technology, Jun. 19, 2008, 2 pages, www.bakerhughes.com.

Warren, K. W. et al., "Desalting Heavy Crude Oils—The Venezuelan Experience", Dec. 2001, NATCO Group, 10 pages.

Refining Process Services, Crude Oil Desalting, 3 pages, www.petroleumrefining.com, Oct. 2007.

*Primary Examiner* — Randy Boyer

(74) *Attorney, Agent, or Firm* — ExxonMobil Upstream Research Company Law Department

(57) ABSTRACT

The invention relates to improved bitumen recovery processes and systems. One process provides for operation of a bitumen froth treatment plant at optimum shear rates in the feed pipe carrying the bitumen froth to the froth settling unit. Another process provides for optimizing the design of a bitumen froth treatment plant by optimizing the diameter of the feed pipe to impart an optimum shear rate to the bitumen froth mixture and further optimizing the volume of the feed pipe to impart an optimum residence time for the bitumen froth stream in the feed pipe. An optimal plant design is also disclosed, the plant including optimal diameter and volume of the feed pipe.

8 Claims, 3 Drawing Sheets

OPTIMIZING FEED MIXER PERFORMANCE IN A PARAFFINIC FROTH TREATMENT PROCESS

CROSS REFERENCE TO RELATED APPLICATION

This application claims the benefit of U.S. Provisional Application No. 61/133,309, filed Jun. 27, 2008.

FIELD OF THE INVENTION

The present invention relates generally to producing hydrocarbons. More specifically, the invention relates to methods and systems for optimizing the performance of feed mixing devices in a solvent based froth treatment process.

BACKGROUND OF THE INVENTION

The economic recovery and utilization of heavy hydrocarbons, including bitumen, is one of the world's toughest energy challenges. The demand for heavy crudes such as those extracted from oil sands has increased significantly in order to replace the dwindling reserves of conventional crude. These heavy hydrocarbons, however, are typically located in geographical regions far removed from existing refineries. Consequently, the heavy hydrocarbons are often transported via pipelines to the refineries. In order to transport the heavy crudes in pipelines they must meet pipeline quality specifications.

The extraction of bitumen from mined oil sands involves the liberation and separation of bitumen from the associated sands in a form that is suitable for further processing to produce a marketable product. Among several processes for bitumen extraction, the Clark Hot Water Extraction (CHWE) process represents an exemplary well-developed commercial recovery technique. In the CHWE process, mined oil sands are mixed with hot water to create slurry suitable for extraction as bitumen froth.

The addition of paraffinic solvent to bitumen froth and the resulting benefits are described in Canadian Patents Nos. 2,149,737 and 2,217,300. According to Canadian Patent No. 2,149,737, the contaminant settling rate and extent of removal of contaminants present in the bitumen froth generally increases as (i) the carbon number or molecular weight of the paraffinic solvent decreases, (ii) the solvent to froth ratio increases, and (iii) the amount of aromatic and napthene impurities in the paraffinic solvent decreases. Further, a temperature above about 30 degrees Celsius (° C.) during settling is preferred.

One reason for processing the heavy hydrocarbon product in such a process is to eliminate enough of the solids to meet pipeline transport specifications and the specifications of the refining equipment. For example, the sediment specification of the bitumen product as measured by the filterable solids test (ASTM-D4807) may be used to determine if the product is acceptable. As such, a higher settling rate of solid particles including mineral solids and asphaltenes from the froth-treated bitumen is desirable.

One of the first steps in a bitumen froth treatment process is to introduce the bitumen froth to a settling tank, where a portion of the asphaltenes and mineral solids settle out of the froth. Stirred tanks and static mixers have been used in such settling tanks. These are very low shear devices. They were used because it was thought that high shear in settling tanks was detrimental to settling and that low shear only impacted quantity of material precipitated, not the precipitation rate.

Methods to improve the settling rate of the minerals can significantly impact the efficiency of heavy hydrocarbon (e.g. bitumen) recovery processes. There exists a need in the art for a low cost method to produce bitumen which meets various sediment specifications.

SUMMARY OF THE INVENTION

In one aspect of the invention, a method of recovering hydrocarbons is provided. The method includes providing a bitumen froth emulsion containing solids, a feed pipe, and a settling unit; determining an optimum average shear rate for the bitumen froth emulsion; and imparting the optimum shear rate to the bitumen froth emulsion in the feed pipe before the bitumen froth emulsion enters the settling unit. The step of determining the optimum average shear may include measuring a solids concentration of the bitumen froth emulsion in the settling unit at a first average shear rate; adjusting the first average shear rate to an adjusted average shear rate; and repeating the measuring and adjusting steps until the solids concentration is at least below a design target for the bitumen froth emulsion.

In another aspect of the invention, a method of optimizing a bitumen treatment process is provided. The method includes determining an optimum average shear rate for a bitumen froth emulsion provided to a settling unit through a feed pipe; determining an optimum residence time in the feed pipe for the bitumen froth emulsion; calculating an optimum diameter of the feed pipe to impart the optimum shear rate to the bitumen froth emulsion; and calculating an optimum volume of the feed pipe to impart the optimum residence time to the bitumen froth emulsion. The step of determining an optimum shear rate may include measuring a solids concentration of the bitumen froth emulsion in the settling unit at a first average shear rate; adjusting the first average shear rate to an adjusted average shear rate; and repeating the measuring and adjusting steps until the solids concentration is at least below a design target for the bitumen froth emulsion.

In another aspect of the invention, a system for recovering hydrocarbons is provided. The system includes a bitumen stream having solids; a solvent stream; a mixing unit configured to mix the bitumen stream and the solvent stream to form a bitumen froth stream; and a feed pipe to receive the bitumen froth stream and provide the bitumen froth stream to a settling unit through a feed pipe inlet, the feed pipe having a diameter and a volume, wherein the diameter of the feed pipe is configured to induce an optimized shear rate to the bitumen froth stream to promote precipitation of solids.

BRIEF DESCRIPTION OF THE DRAWINGS

The foregoing and other advantages of the present invention may become apparent upon reviewing the following detailed description and drawings of non-limiting examples of embodiments in which.

DETAILED DESCRIPTION

Figure 1:
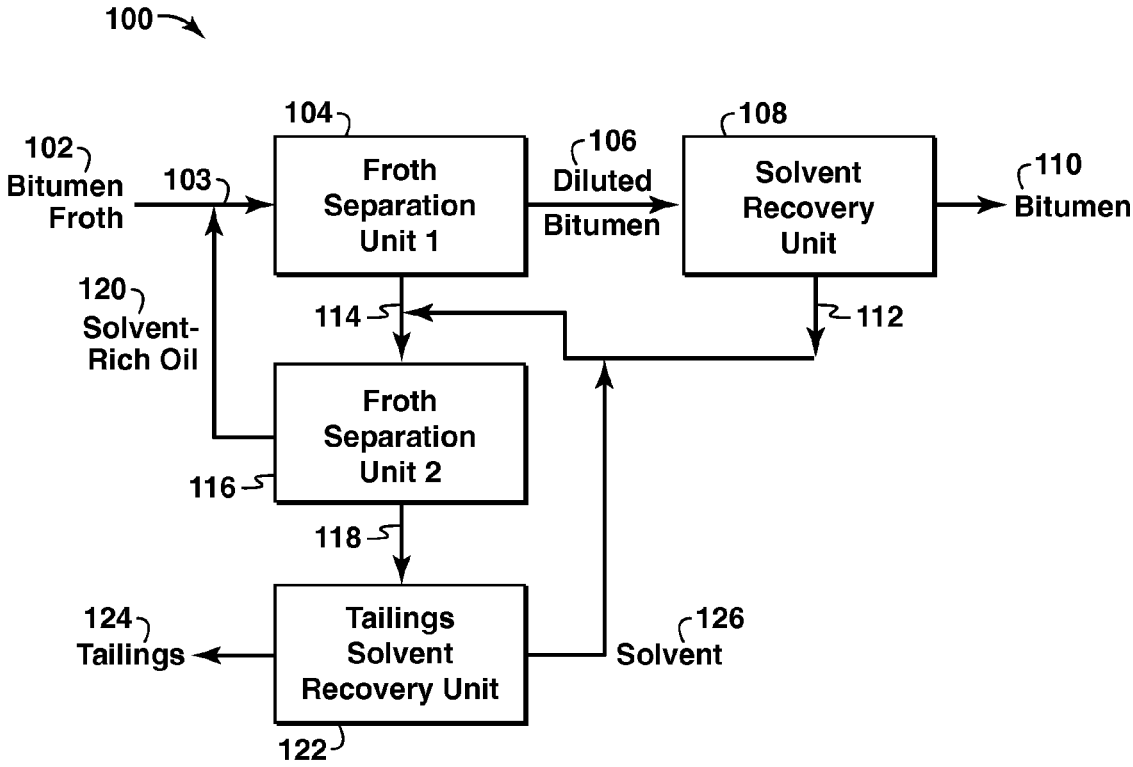
FIG. 1 Prior Art
FIG. 1 is a schematic of an exemplary prior art bitumen froth treatment plant layout.

In the following detailed description section, the specific embodiments of the present disclosure are described in connection with preferred embodiments. However, to the extent that the following description is specific to a particular embodiment or a particular use of the present disclosure, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

The term "asphaltenes" as used herein refers to hydrocarbons which are the n-heptane insoluble, toluene soluble component of a carbonaceous material such as crude oil, bitumen or coal. One practical test to determine if oil is an asphaltene is to test whether the oil is soluble when blended with 40 volumes of toluene but insoluble when the oil is blended with 40 volumes of n-heptane. If so, the oil may be considered an asphaltene. Asphaltenes are typically primarily comprised of carbon, hydrogen, nitrogen, oxygen, and sulfur as well as trace amounts of vanadium and nickel. The carbon to hydrogen ratio is generally about 1:1.2, depending on the source.

The term "bitumen" as used herein refers to heavy oil. In its natural state as oil sands, bitumen generally includes asphaltenes and fine solids such as mineral solids.

The term "paraffinic solvent" (also known as aliphatic) as used herein means solvents containing normal paraffins, isoparaffins and blends thereof in amounts greater than 50 weight percent (wt %). Presence of other components such as olefins, aromatics or naphthenes counteract the function of the paraffinic solvent and hence should not be present more than 1 to 20 wt % combined and preferably, no more than 3 wt % is present. The paraffinic solvent may be a C4 to C20 paraffinic hydrocarbon solvent or any combination of iso and normal components thereof. In one embodiment, the paraffinic solvent comprises pentane, iso-pentane, or a combination thereof. In one embodiment, the paraffinic solvent comprises about 60 wt % pentane and about 40 wt % iso-pentane, with none or less than 20 wt % of the counteracting components referred above.

In the prior art, mixing has been done using stirred tanks and/or static mixers. No information is available on the effect of shear on the performance of the settler for this type of process. Testing during process development indicated that performance of the settler is clearly dependent on shear and that an optimum exists (see FIG. 4 and related text). This was an unexpected result, since the commonly held position was that high shear alone was detrimental to settling. Poor mixing at low shear was expected to impact the quantity of material precipitated and not the precipitation rate.

The disclosure further proposes that mixing can be adequately achieved using a tee-mixer and turbulence in the feed (transport) pipe used for feeding the froth-solvent mixture to the settler. The turbulence in the pipe controls the shear. The amount of shear and residence time in the pipe significantly impact optimal operation of the settler.

More specifically, the invention relates to processes and systems for recovering hydrocarbons. In one aspect, the invention is a process to partially upgrade a bitumen or heavy crude and is particularly suited for bitumen froth generated from oil sands which contain bitumen, water, asphaltenes and mineral solids. The process includes mixing a bitumen stream with a solvent stream to form a bitumen froth stream, feeding the bitumen froth stream to a settling unit through a feed pipe, then determining an optimum average shear rate for the emulsion, and imparting the optimum shear rate to the bitumen froth emulsion in the feed pipe prior to the emulsion entering the settling unit.

Another method is a method of optimizing a bitumen treatment process or process plant. The method includes mixing a bitumen stream with a solvent stream to form a bitumen froth emulsion, feeding the bitumen froth emulsion to a settling unit through a feed pipe, determining an optimum average shear rate for the bitumen froth emulsion, calculating an optimum diameter of the feed pipe to impart the optimum shear rate to the bitumen froth emulsion, determining an optimum residence time in the feed pipe for the bitumen froth emulsion, and calculating an optimum volume of the feed pipe to impart the optimum residence time to the bitumen froth emulsion.

In another aspect, the invention relates to a system for recovering hydrocarbons. The system may be a plant located at or near a bitumen (e.g. heavy hydrocarbon) mining or recovery site or zone. The plant may include a bitumen stream, a solvent stream, and a mixing unit for mixing the bitumen and solvent stream to form a bitumen froth stream. The plant further includes a feed pipe having a volume configured to contain the bitumen froth stream for a time sufficient to promote precipitation from the bitumen froth stream. The feed pipe further includes a diameter configured to induce an optimized shear to the bitumen froth stream configured to promote maximum solids precipitation at the conditions of the bitumen froth stream. The plant further includes a settling unit configured to receive the bitumen froth stream. In one embodiment of the invention, the setting unit of the present invention may be smaller than a settling unit in a conventional bitumen treatment plant. The plant may also include at least one tailings solvent recovery unit (TSRU), solvent storage unit, pumps, compressors, and other equipment for treating and handling the heavy hydrocarbons and byproducts of the recovery system.

Referring now to the figures, FIG. 1 is a schematic of an exemplary prior art paraffinic froth treatment system. The plant 100 receives bitumen froth 102 from a heavy hydrocarbon recovery process. The bitumen froth 102 is fed into a feed pipe 103, which carries it to a first settling unit 104 (or froth separation unit (FSU) 104) where solvent or solvent-rich oil 120 is mixed with the bitumen froth 102. A diluted bitumen stream 106 and a tailings stream 114 are produced from the FSU 104. The diluted bitumen stream 106 is sent to a solvent recovery unit (SRU) 108, which separates bitumen from solvent to produce a bitumen stream 110 that meets pipeline specifications. The SRU 108 also produces a solvent stream 112, which is mixed with tailings 114 from the first FSU 104 and fed into a second froth separation unit 116. The second FSU 116 produces a solvent rich oil stream 120 and a tailings stream 118. The solvent rich oil stream 120 is mixed with the incoming bitumen froth 102 and the tailings stream is sent to a tailings solvent recovery unit 122, which produces a tailings stream 124 and a solvent stream 126.

In an exemplary embodiment of the process the bitumen froth 102 may be mixed with a solvent-rich oil stream 120 from FSU 116 in FSU 104. The temperature of FSU 104 may be maintained at about 60 to 80 degrees Celsius (° C.), or about 70° C. and the target solvent to bitumen ratio is about 1.4:1 to 2.2:1 by volume or about 1.6:1 by volume. The overflow from FSU 104 is the diluted bitumen product 106 and the bottom stream 114 from FSU 104 is the tailings substantially comprising water, mineral solids, asphaltenes, and some residual bitumen. The residual bitumen from this bottom stream is further extracted in FSU 116 by contacting it with fresh solvent (from e.g. 112 or 126), for example in a 25:1 to 30:1 by volume solvent to bitumen ratio at, for instance, 80 to 100° C., or about 90° C. The solvent-rich overflow 120 from FSU 116 is mixed with the bitumen froth feed 102. The bottom stream 118 from FSU 116 is the tailings substantially comprising solids, water, asphaltenes, and residual solvent. The bottom stream 118 is fed into a tailings solvent recovery unit (TSRU) 122, a series of TSRUs or by another recovery method. In the TSRU 122, residual solvent is recovered and recycled in stream 126 prior to the disposal of the tailings in the tailings ponds (not shown) via a tailings flow line 124. Exemplary operating pressures of FSU 104 and FSU 116 are respectively about 550 thousand Pascals gauge (kPag) and about 600 kPag. FSUs 104 and 116 are typically made of carbon-steel but may be made of other materials.

Figure 2A:
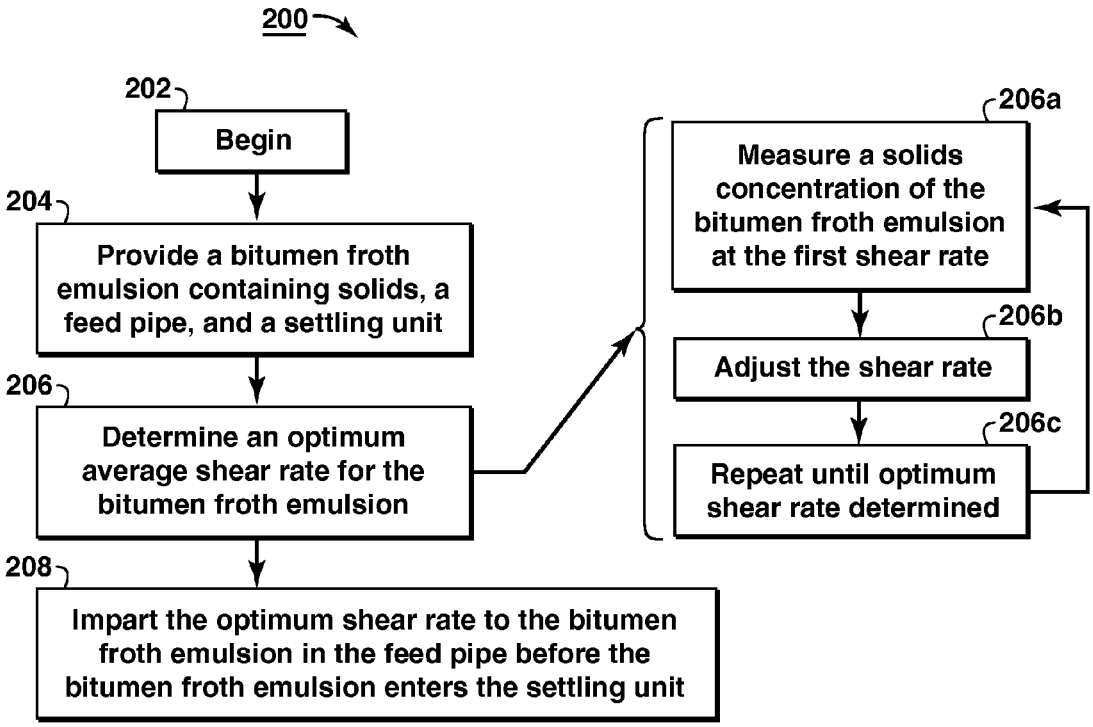
FIG. 2A is a flow chart of a bitumen froth treatment process including at least one aspect of the present invention.

FIG. 2A is an exemplary flow chart of a method for recovering hydrocarbons in bitumen froth treatment process similar to the plant shown in FIG. 1. As such, FIG. 2A may be best understood with reference to FIG. 1. The process 200 begins at block 202, then includes providing a bitumen froth emulsion or mixture containing solids, a feed pipe, and a settling unit 204. Next, determining an optimum average shear rate for the bitumen froth emulsion 206; and imparting the optimum shear rate to the bitumen froth emulsion in the feed pipe before the bitumen froth emulsion enters the settling unit 208. The step of determining the optimum average shear rate for the bitumen froth emulsion 206 may optionally comprise the steps of measuring a solids concentration of the bitumen froth emulsion in the settling unit at a first average shear rate 206*a*; adjusting the first average shear rate to an adjusted average shear rate 206*b*; and repeating the measuring and adjusting steps until the solids concentration is at least below a design target for the bitumen froth emulsion 206*c*.

Referring to FIGS. 1 and 2A, the step of providing the bitumen froth emulsion 204 may also include the steps of extracting a heavy hydrocarbon (e.g. bitumen). An exemplary composition of the resulting bitumen froth 102 is about 60 wt % bitumen, 30 wt % water and 10 wt % solids, with some variations to account for the extraction processing conditions. In such an extraction process oil sands are mined, bitumen is extracted from the sands using water (e.g. the CHWE process, SAGD, SAVES, VAPEX, SRBR, FIRE, a cold water extraction process such as CHOPS, some combination of these or some other process), and the bitumen is separated as a froth comprising bitumen, water, solids and air. In the extraction step air is added to the bitumen/water/sand slurry to help separate bitumen from sand, clay and other mineral matter. The bitumen attaches to the air bubbles and rises to the top of the separator (not shown) to form a bitumen-rich froth 102 while the sand and other large particles settle to the bottom. Regardless of the type of oil sand extraction process employed, the extraction process will typically result in the production of a bitumen froth product stream 102 comprising bitumen, water and fine solids (including asphaltenes, mineral solids) and a tailings stream 114 consisting essentially of water and mineral solids and some fine solids.

In one embodiment of the process 200 solvent 120 is added to the bitumen-froth 102 after extraction and the mixture is pumped to another separation vessel (froth separation unit or FSU 104) via the feed pipe 103. The addition of solvent 120 helps remove the remaining fine solids and water. Put another way, solvent addition increases the settling rate of the fine solids and water out of the bitumen mixture. In one embodiment of the recovery process 200 a paraffinic solvent is used to dilute the bitumen froth 102 before separating the product bitumen by gravity in a device such as FSU 104. Where a paraffinic solvent is used (e.g. when the weight ratio of solvent to bitumen is greater than 0.8), a portion of the asphaltenes in the bitumen are rejected thus achieving solid and water levels that are lower than those in existing naphtha-based froth treatment (NFT) processes. In the NFT process, naphtha may also be used to dilute the bitumen froth 102 before separating the diluted bitumen by centrifugation (not shown), but not meeting pipeline quality specifications. In prior art processes, there was little or no appreciation for the shear rate applied to the bitumen froth 102 as it passed through the feed pipe 103 to the settling unit 104 (e.g. FSU 104).

In one alternative embodiment of the process 200, shear may be imparted to the bitumen froth emulsion 102 by the feed pipe 103 alone, wherein the feed pipe 103 has a diameter configured to impart the shear to the bitumen froth emulsion 102. In another aspect, a supplemental mixing unit may be incorporated into the feed pipe 103 to optimize the shear rate for the conditions in the pipeline. In addition, the residence time of the bitumen froth emulsion 102 in the feed pipe 103 may be measured and optimized to provide the lowest possible solids concentration in the bitumen froth emulsion 102. The volume of the feed pipe 103 has a direct impact on the residence time. The volume of the feed pipe 103 can be altered by changing the length of the feed pipe as the diameter should be optimized to provide the optimum shear rate. The present disclosure teaches the importance of optimizing the size of the feed pipe 103 to the treatment of bitumen froth emulsions. Beneficially, optimization of the feed pipe diameter and volume permits the use of smaller and more simplified equipment in the settling unit 104. For example, the use of a static mixer or impeller is no longer necessary using the process of the present invention. These mixing devices can be expensive to provide and maintain and are susceptible to fouling.

Figure 2B:
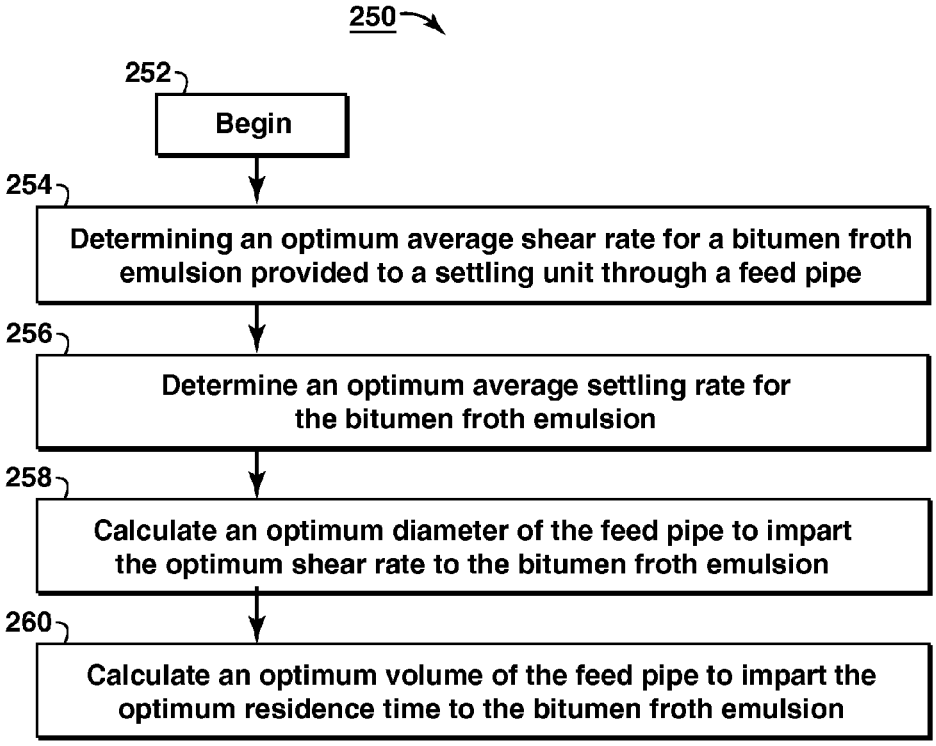
FIG. 2B is a flow chart of a method of optimizing a bitumen froth treatment plant or process including at least one aspect of the present invention.

FIG. 2B is an exemplary flow chart of an alternative method for optimizing a bitumen froth treatment process, such as the plant shown in FIG. 1. As such, FIG. 2B may be best understood with reference to FIG. 1. The optimization process begins at block 252, then includes determining an optimum average shear rate for a bitumen froth emulsion provided to a settling unit through a feed pipe 254; determining an optimum residence time in the feed pipe for the bitumen froth emulsion 256; calculating an optimum diameter of the feed pipe to impart the optimum shear rate to the bitumen froth emulsion 258; and calculating an optimum volume of the feed pipe to impart the optimum residence time to the bitumen froth emulsion 260.

The optimization method may be carried out before, during or after construction of a bitumen treatment plant (e.g. plant 100), but is preferably done in the design stages before the plant is constructed so that the FSU 104 and other parts of the plant 100 may be optimized along with the feed pipe 103. The optimum average shear rate determining step may include measuring a solids concentration (in parts per million or ppm) of the bitumen froth emulsion in the settling unit at a first average shear rate; adjusting the first average shear rate to an adjusted average shear rate; and repeating the measuring and adjusting steps until the solids concentration is at least below a design target for the bitumen froth emulsion. The residence time determining step may include measuring the solids concentration of the bitumen froth emulsion in the settling unit at a first residence time; adjusting the residence time to an adjusted residence time; and repeating the measuring and adjusting steps until the solids concentration is at least below the design target for the bitumen froth emulsion.

The solids concentration may be measured using a variety of methods and apparatuses known in the art, including those disclosed in co-pending, commonly assigned U.S. patent application Ser. No. 12/336,192, entitled "Method of Removing Solids From Bitumen Froth," the portions of which dealing with determining solids concentration are hereby incorporated by reference. The design target may vary significantly depending on the bitumen feed composition, the extraction process used (e.g. CHWE, CHOPS, SAGD, etc.), the amount and type of solvent used (e.g. butanes, hexanes, pentanes, octanes, or some combination), and other factors. A test device has been designed and configured for use in the optimizing process 250.

Figure 3:
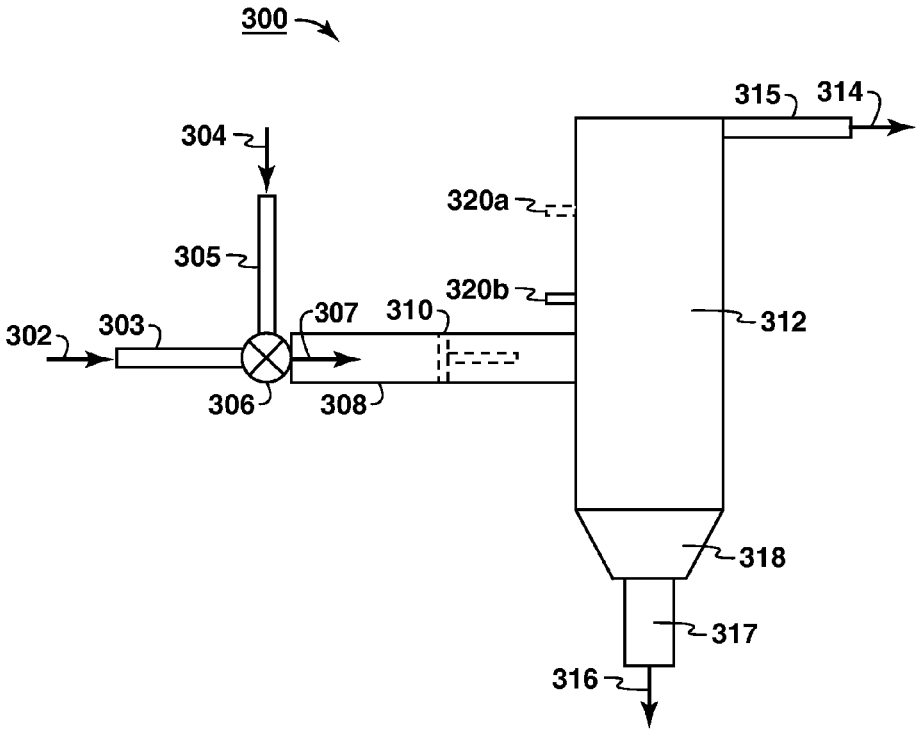
FIG. 3 is a schematic of an exemplary bitumen froth treatment plant layout including at least one aspect of the present invention.

Experiments were conducted to test the optimum shear rate and residence time for particular mixtures of bitumen froth emulsions. An experimental system was set up similar to the device of FIG. 3. The system 300 includes a bitumen inlet stream 302, a bitumen inlet conduit 303, a solvent inlet stream 304, solvent inlet conduit 305, and a mixing unit or mixing area 306. The mixing unit may be a simple tee-mixer or T-junction where the streams 302 and 304 combine. The streams 302 and 304 become a mixed stream 307 upon exiting the mixing unit or mixing area 306. The system 300 further includes a feed pipe 308, and a settling unit 312 having a top outlet conduit 315 and a bottom outlet conduit 317. The system 300 further includes at least one measurement port 320*b* above the location of the feed pipe 308 inlet to the settling unit 312 for measuring the solids content of the mixed stream 307. The top outlet conduit 315 is configured to carry a diluted bitumen stream 314 having relatively low solids concentration and the bottom outlet conduit 317 is configured to carry a tailings stream 316 having a relatively high concentration of solids.

Some variations of the test system 300 include additional measuring ports 320*a*, an optional supplemental mixing unit 310 (e.g. a static mixer impeller, shear plates, a holding tank or any other means of shearing stream 307), and a conical section 318 of the settling unit 312 before the bottom outlet 317. The system 300 is designed such that multiple readings can be taken at different parts of the system and changes to the feed pipe 308 can be made relatively easily. The settling unit 312 may be significantly smaller than a commercial FSU 104, but large enough to obtain accurate measurements.

EXAMPLES

Figure 4:
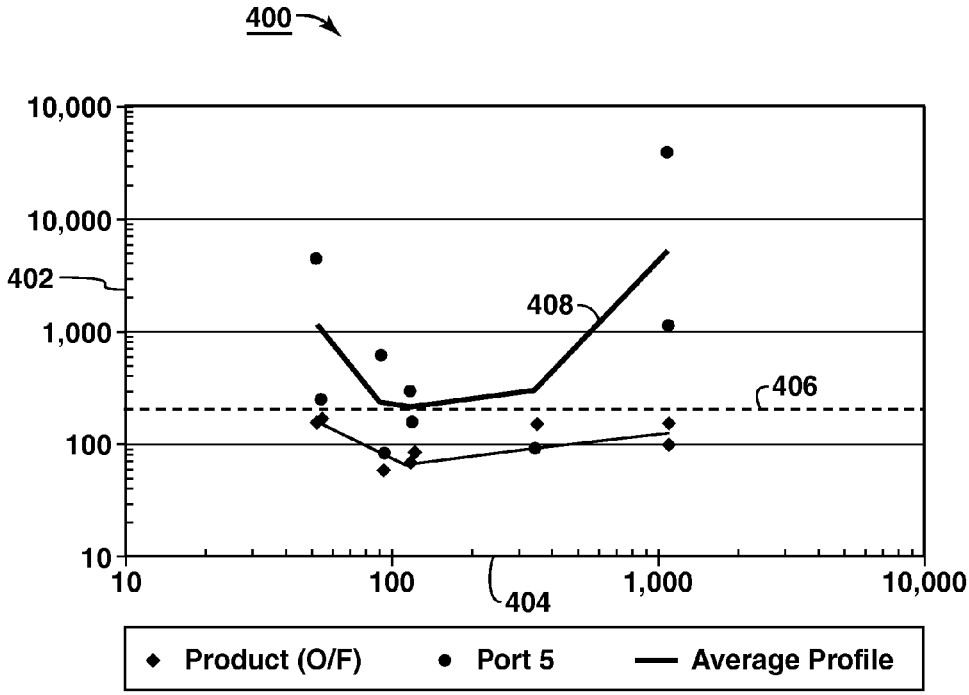
FIG. 4 is a schematic illustration of the experimental apparatus utilized with the present invention as disclosed in FIGS. 2 and 3.

FIG. 4 is a graph showing exemplary results of testing done in a pilot plant utilizing the system 300. The graph 400 compares solids concentration in parts per million weight (ppmw) 402 versus average shear rate in inverse seconds (s−1) 404 at a flux rate of about 550 millimeters per minute (mm/min). The diamonds show the concentration of solids (clay type material) in the product 307 at varying shear rates in the feed pipe 308. These measurements were taken from a location well above the feed pipe inlet at a location like port 320*a*. Shear was changed by varying the feed pipe 308 diameter. From the graph 400, it appears that a shear rate of about 125 $s^{-1}$ can be considered optimal. However, a 40-3,200 $s^{-1}$ was tested and found still to be under the design target 406 of about 125 ppmw. The circular dots indicate measurements of the concentration of the solids a few inches above the feed location, such as via port 320*b*. In other words, these measurements were taken just above the feed pipe inlet port. This indicates a larger variability with shear at heights close to inlet. The implication here is that a tall settler 312 may not require optimal shear conditions, but for shorter settlers (recall, it is desirable to make the settler small) an optimum shear rate is necessary to maintain the stream 307 within the design target 406.

Residence time was also varied and it was found that very short residence times of less than about 2 seconds increase the likelihood of high solids concentration. A feed pipe residence time of about 2-60 sec were tested and found to be in the optimal range. Larger feed pipe volumes equate to longer residence time. These findings show that both the diameter and total volume of the feed pipe are significant optimizing factors in bitumen froth treatment processes.

While the present invention may be susceptible to various modifications and alternative forms, the exemplary embodiments discussed above have been shown only by way of example. However, it should again be understood that the invention is not intended to be limited to the particular embodiments disclosed herein. Indeed, the present invention includes all alternatives, modifications, and equivalents falling within the true spirit and scope of the appended claims.

What is claimed is:

1. A method of recovering hydrocarbons, comprising:

providing a bitumen froth emulsion containing solids, a feed pipe, and a settling unit;

determining an optimum average shear rate for the bitumen froth emulsion; and imparting the optimum average shear rate to the bitumen froth emulsion in the feed pipe before the bitumen froth emulsion enters the settling unit.

2. The method of claim 1, the step of determining an optimum average shear rate further comprising:

measuring a solids concentration of the bitumen froth emulsion in the settling unit at a first average shear rate;

adjusting the first average shear rate to an adjusted average shear rate; and repeating the measuring and adjusting steps until the solids concentration of the bitumen froth emulsion is at least below a design target for the bitumen froth emulsion.

3. The method of claim 2, wherein the imparting the optimum average shear rate step is accomplished using at least one of: a tee-mixer and pipeline turbulence.

4. The method of claim 2, wherein the optimum average shear rate is from about 100 $s^{-1}$ to about 200 $s^{-1}$.

5. The method of claim 2, wherein the design target is from about 100 parts per million weight (ppmw) to about 200 ppmw.

6. The method of claim 2, further comprising determining an optimum residence time in the feed pipe for the bitumen froth emulsion; and imposing the optimum residence time in the feed pipe to the bitumen froth emulsion.

7. The method of claim 6, the step of determining the optimum residence time further comprising:

measuring a solids concentration of the bitumen froth emulsion in the settling unit at a first residence time;

adjusting the first residence time to an adjusted residence time; and repeating the measuring and adjusting steps until the solids concentration is at least below a design target for the bitumen froth emulsion.

8. The method of claim 1, further comprising providing a flux rate of the bitumen froth stream in the settling unit, wherein the flux rate is from about 500 millimeters per minute (mm/min) to about 600 mm/min.

* * * * *